US005157926A

United States Patent [19]

Guilleminot

[11] Patent Number: 5,157,926

[45] Date of Patent: Oct. 27, 1992

[54] PROCESS FOR REFRIGERATING, CORRESPONDING REFRIGERATING CYCLE AND THEIR APPLICATION TO THE DISTILLATION OF AIR

[75] Inventor: Odile Guilleminot, Lesigny, France

[73] Assignee: L'air Liquide, Societe Anonyme Pour L'etude et l'exploitation des Procedes Georges Claude, Paris, France

[21] Appl. No.: 583,433

[22] Filed: Sep. 17, 1990

[30] Foreign Application Priority Data

Sep. 25, 1989 [FR] France ..... 89 12517

[51] Int. Cl.[5] ..... F25J 3/02

[52] U.S. Cl. ..... 62/24; 62/38; 62/87

[58] Field of Search ..... 62/13, 24, 38, 86, 87, 62/88, 39

[56] References Cited

U.S. PATENT DOCUMENTS

| | | | |
|---|---|---|---|
| 3,559,417 | 2/1971 | Hoffman | 62/39 |
| 3,605,422 | 9/1971 | Pryor et al. | 62/13 |
| 3,950,957 | 4/1976 | Zakon | 62/13 |
| 4,072,023 | 2/1978 | Springmann | 62/39 |
| 4,303,428 | 12/1981 | Vandebussche | 62/38 |
| 4,357,153 | 11/1982 | Erickson | 62/39 |
| 4,522,636 | 6/1985 | Markbreiter et al. | 62/87 |
| 4,715,873 | 12/1987 | Auvil et al. | 62/38 |

FOREIGN PATENT DOCUMENTS

| | | |
|---|---|---|
| 0316768 | 5/1989 | European Pat. Off. . |
| 3429420 | 3/1985 | Fed. Rep. of Germany . |
| 2026570 | 9/1970 | France . |
| 0002626 | 9/1967 | Japan . |

*Primary Examiner*—Ronald C. Capossela
*Attorney, Agent, or Firm*—Young & Thompson

[57] ABSTRACT

The incoming compressed air is partly expanded in a high pressure turbine, after which a portion of the expanded air is again expanded in a low pressure turbine. The inlet temperature of the latter is clearly higher than that of the high pressure turbine. Application to the production of liquid nitrogen and liquid oxygen.

14 Claims, 3 Drawing Sheets

PROCESS FOR REFRIGERATING, CORRESPONDING REFRIGERATING CYCLE AND THEIR APPLICATION TO THE DISTILLATION OF AIR

BACKGROUND OF THE INVENTION a) Field of the Invention

The present invention relates to refrigerating production. Particularly, it applies to the liquefaction of the gases found in air and to apparatuses for the distillation of air. It is first concerned with a process for refrigerating production by expansion of a fluid in a first turbine called high pressure turbine followed by expansion of a portion of the fluid originating from this turbine in a second turbine called low pressure turbine.

b) Description of the Prior Art

In the known processes of this type, the high pressure turbine is the "hot" turbine, i.e. its inlet temperature is higher than that of the low pressure turbine. Such an arrangement has some disadvantages:

the fact of limiting the cooling of the total incoming air to the inlet temperature of the hot turbine is unfavourable to heat exchange;

the "cold" turbine treats a reduced flow of fluid, while it produces less cold per unit of flow of fluid and it is indeed in the cold zone that the most important quantity of cold is required when a gas has to be liquefied; however, it is also in this cold zone that heat losses are the most important.

SUMMARY OF THE INVENTION

The invention aims at providing a process enabling to improve heat exchange and to better adapt refrigerating production to current need.

For this purpose, it is an object of the invention to provide a process of the type mentioned above, characterized in that the inlet temperature of the high pressure turbine is clearly lower than that of the low pressure turbine.

Another object of the invention is to provide a refrigerating cycle intended to operate such a process. This refrigerating cycle, of the type comprising a circuit for circulating a cycle fluid, a cycle compressor, a first turbine called high pressure turbine, and a second turbine called low pressure turbine, the circuit comprising means enabling at least a portion of the compressed cycle fluid to pass through the compressor, after cooling to a first temperature in the high pressure turbine, and means enabling at least a portion of the fluid originating from this turbine to pass through the low pressure turbine, is characterized in that the inlet temperature of the high pressure turbine is clearly lower than that of the low pressure turbine.

In its application to the distillation of air, it is also an object of the invention to provide:

a process for air distillation, of the type in which compressed air is cooled and expanded at a mean pressure in a first turbine called high pressure turbine, and a portion of the air so expanded is sent to a double distillation column while the remaining air so expanded is again expanded up to the vicinity of atmospheric pressure in a second turbine called low pressure turbine, characterized in that the inlet temperature of the high pressure turbine is clearly lower than that of the low pressure turbine; and an apparatus for air distillation, of the type comprising a double column for distillation of air and a refrigerating cycle, characterized in that the refrigerating cycle is such as defined above, the cycle fluid being air to be separated, the apparatus comprising means to cool a portion of the incoming air down to the vicinity of its dew point, to expand same in an expansion valve and to send it to the double column, and means to send to this double column a portion of the air originating from the high pressure turbine.

BRIEF DESCRIPTION OF DRAWINGS

Examples of operating the invention will now be described with reference to the annexed drawings on which.

DESCRIPTION OF PREFERRED EMBODIMENTS

Figure 1:
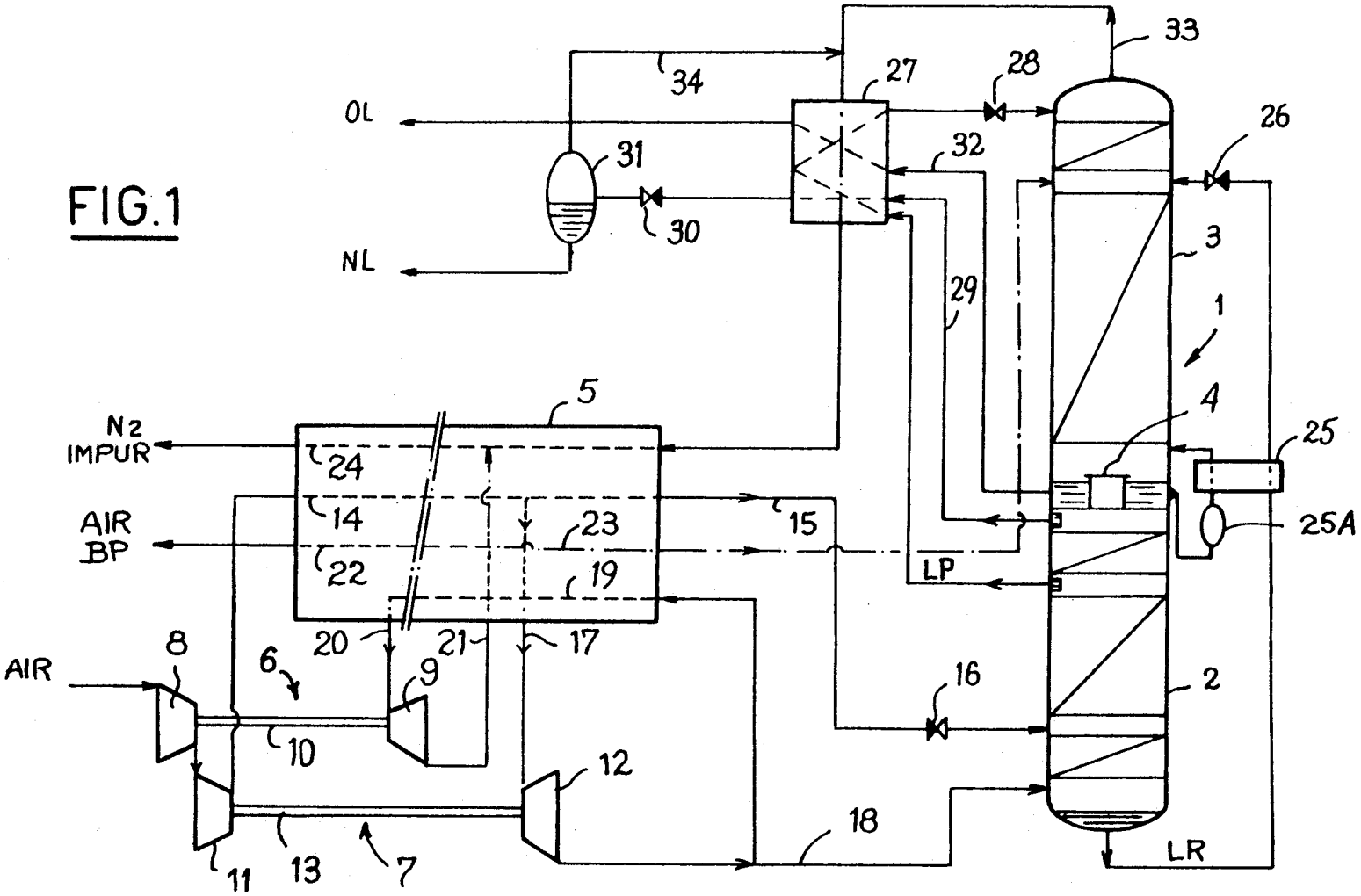
FIG. 1 is a schematic view of an apparatus for distillation of air according to the invention.

The apparatus for distillation of air represented in FIG. 1 is intended to produce oxygen and nitrogen in liquid form. It comprises a double distillation column 1, the latter comprising a mean pressure column 2 operating at about six bars absolute, which is surmounted by a low pressure column 3, operating slightly above atmospheric pressure. The gas in the head portion (nitrogen) of column 2 is in indirect heat exchange relationship with the liquid in the vat portion (oxygen) of the column 3 by means of a vaporizer-condenser 4.

The apparatus also comprises a heat exchange line 5 with counter-current circulation of the fluids in heat exchange relationship, and two turbine-booster units 6 and 7. Unit 6 comprises a booster 8 and a "hot" low pressure turbine 9 mounted on the same shaft 10, and unit 7 comprises a booster 11 and a cold high pressure turbine 12 mounted on the same shaft 13. The two boosters 8 and 11 are mounted in series.

The air to be separated, compressed at about 20 bars and free from water and $CO_2$ is boosted at about 30 bars by the unit consisting of the first booster 8 and the second booster 11, after which it is cooled down to a temperature T1, for example of the order of −125° C., in ducts 14 of the exchange line 5. A portion, for example about one quarter, of this air continues to be cooled until reaching the cold end of the heat exchange line, in the same ducts 14, from which it exits in liquid state, after which, via duct 15, it is expanded at six bars in an expansion valve 16 and is injected at the bottom of column 2. As a variant, all or a portion of this liquid can be expanded at the low pressure and injected into the column 3. The remaining air at 30 bars is taken out of the exchange line 5 through duct 17 and is expanded at 6 bars in turbine 12 from which it exits at about its dew point.

A portion of the air which originates from the turbine 12, corresponding for example to about half the flow of the initial air, is sent to the vat portion of column 2 through duct 18 and the remaining portion is warmed up in ducts 19 of the exchange line, from the cold end of the latter to a temperature T2 which is clearly higher than T1. This temperature T2 may for example be between room temperature and about −30° C.

The air thus warmed up is taken out of the exchange line via duct 20 and is expanded up to about atmospheric pressure in turbine 9, from which it exits at a temperature in the vicinity of T1. It is thereafter reintroduced into the exchange line via duct 21, warmed up to room temperature in ducts 22 and is evacuated from the apparatus, after having eventually been used to regenerate an adsorbent used for purifying incoming air and/or to cool outgoing air from the main compressor (not illustrated) of the apparatus.

As a variant, as represented in mixed line in FIG. 1, all or a portion of the air which originates from turbine 9 can be cooled until reaching the cold end of the exchange line in ducts 23 after which it is forced into low pressure column 3, or if desired it can be mixed with impure nitrogen, constituting the residual portion of the double column, which is being warmed in ducts 24 of the exchange line.

The remaining portion of the apparatus is well known: the rich liquid LR (oxygen enriched air) collected in the vat portion of column 2 is sent into column 3 after sub-cooling in a sub-cooler 25 by vaporizing liquid oxygen withdrawn from the vat of column 3, filtrated in 25A and sent into column 3, after which it is expanded in an expansion valve 26, and poor liquid LP essentially consisting of nitrogen, withdrawn in the upper portion of column 2, is also sent into column 3 after sub-cooling in a sub-cooler 27 after which it is expanded in an expansion valve 28. The apparatus produces on the one hand liquid nitrogen, taken up in the head portion of column 2 via duct 29, which is sub-cooled in sub-cooler 27, expanded at about of atmospheric pressure in an expansion valve 30 and stored in a container 31, and on the other hand liquid oxygen, taken up in the vat portion of column 3 via a duct 32 and sub-cooled in sub-cooler 27. The latter is cooled by means of impure nitrogen withdrawn in the head portion of column 3 via a duct 33 and thereafter sent to ducts 24 of the exchange line. Gaseous nitrogen formed in the container 31 is sent into duct 33 via a duct 34.

By means of the arrangement of the two turbines described above, the entire over-pressurized air is cooled down to the inlet temperature of the cold turbine, i.e. down to −125° C. in this example. With respect to the reversed known arrangement of the two turbines, this increases the frigorific input of the air under pressure as a result of the Joule - Thompson effect in the temperature zone which extends from the inlet of the hot turbine to that of the cold turbine.

Figure 2:
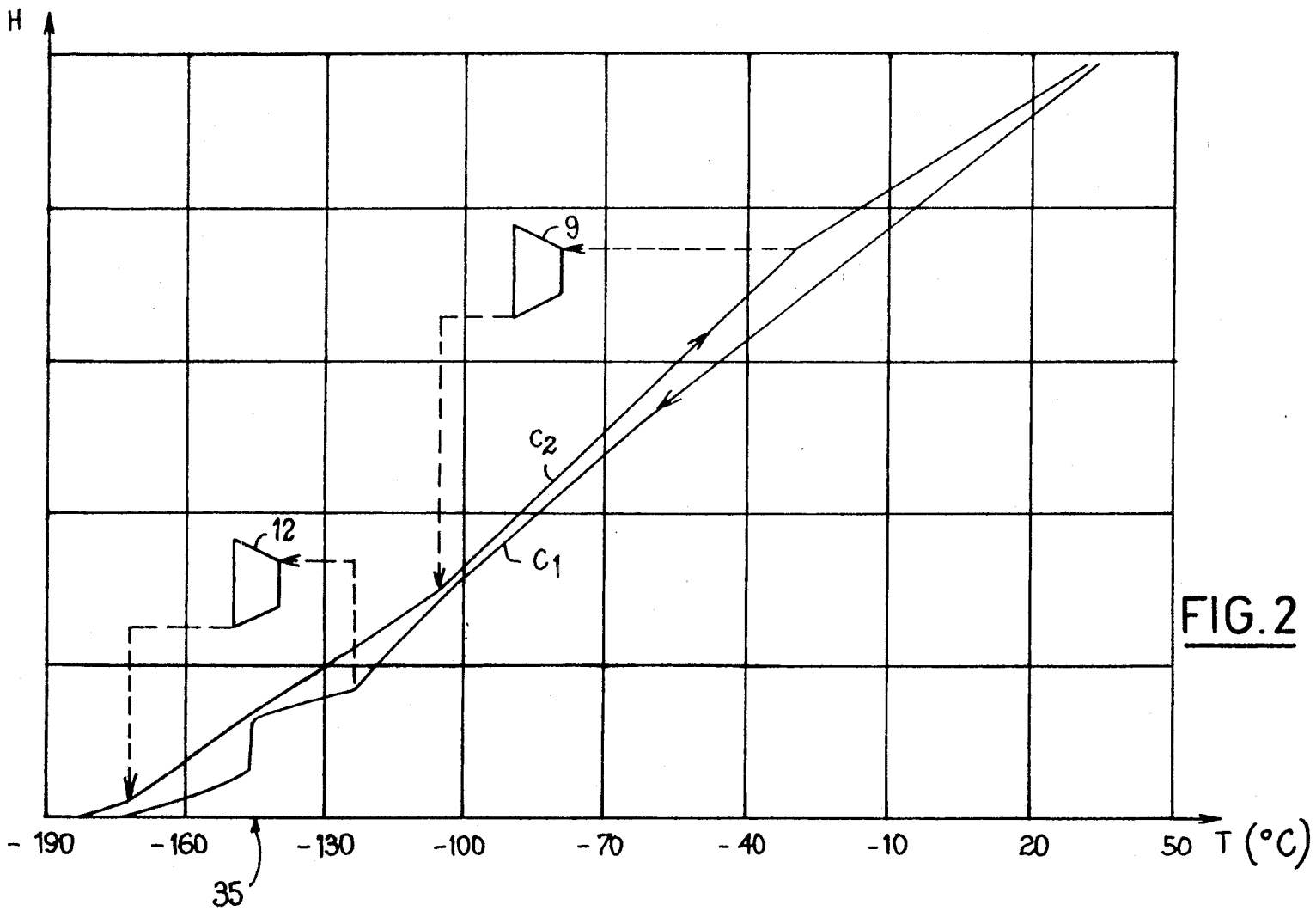
FIG. 2 is a heat exchange diagram corresponding to this apparatus.

On the other hand, with reference to FIG. 2, where the temperature in degrees C has been shown in abscissae and the enthalpy H, is given in ordinates, the lower curve C1 represents the variation of enthalpy of the air being cooled and liquefied, and the upper curve C2 represents the variation of enthalpy of the gas being warmed up. It will be seen that:

the cold turbine 12 treats a high flow of air with inlet and outlet temperatures which border the liquefaction zone of the air 35, i.e. it produces much more cold in spite of its operation at low temperature, moreover it produces this cold in the temperature zone where, precisely, a lot of cold is required to liquefy the air and where, on the other hand, heat losses are at a maximum; and the hot turbine treats a small flow of air and may recover, by ensuring an expansion from 6 bars to 1 bar, the essential of the temperature zone located above the previous one and in which the cooling is ensured by the turbines; so, the turbine 9 produces little cold in a wide zone of temperature, where, precisely, a little cold is required, the products in heat exchange relationship being gaseous, and where, on the other hand, the losses are small.

It results from the above considerations that the apparatus of FIG. 1 leads to a reduced specific energy of liquefaction. It will also be noted that the air at mean pressure which circulates in duct 18 may without inconvenience be in the vicinity of its dew point which is of interest for distillation in the double column.

Figure 3:
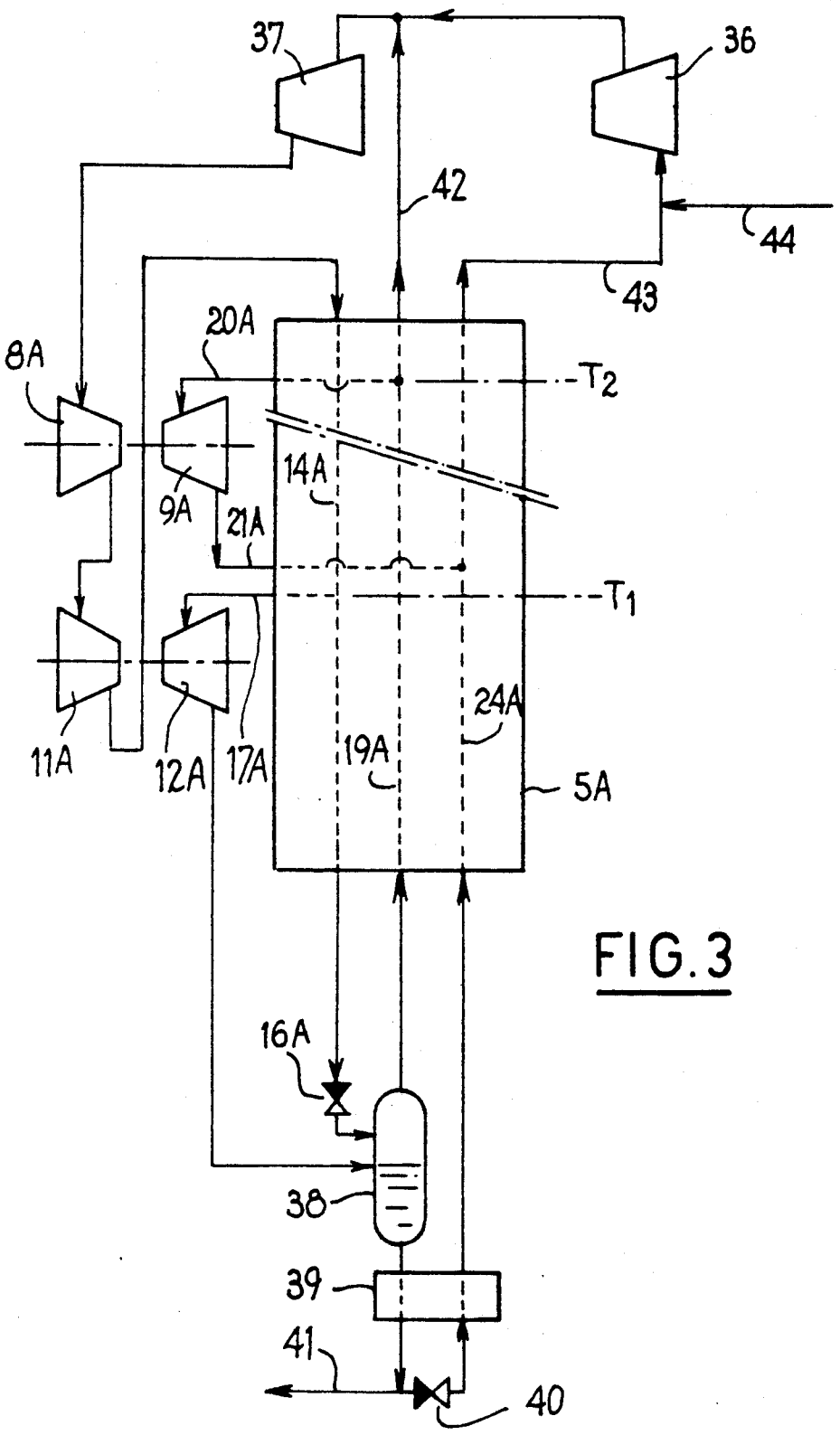
FIG. 3 is a schematic view of a cycle of liquefaction according to the invention.

The advantage concerning the specific energy of liquefaction is found in the liquefaction cycle of nitrogen represented in FIG. 3. On this figure, the elements corresponding to FIG. 1 are referred by the same reference numerals, except that the suffix A is added. Thus, there is found a heat exchange line 5A, a first booster 8A coupled to a low pressure hot turbine 9A and a second booster 11A coupled to a high-pressure cold turbine 12A and the cycle additionally comprises two cycle compressors 36 (1 bar to 6 bars) and 37 (6 bars to 30 bars) mounted in series.

The cycle nitrogen forced by the compressor 37 is over pressurized at 50 bars by the unit comprising boosters 8A and 11A and is introduced in ducts 14A of the exchange line. A portion of this nitrogen continues to be cooled until reaching the cold end of the exchange line, is expanded at mean pressure (6 bars) in an expansion valve (16A) and is separated into two phases, one liquid phase and one vapour phase, in a separator pot 38. The vapour phase is warmed up to room temperature in ducts 19A of the exchange line, and the liquid phase is subcooled in a sub-cooler 39. A portion of this sub-cooled liquid is expanded at about 1 bar in an expansion valve 40, is vaporized in sub-cooler 39 with liquid reflux, after which it is warmed up to room temperature in ducts 24A of the exchange line. The remaining sub-cooled liquid constitutes the production of liquid nitrogen, which is withdrawn via duct 41.

The non-liquefied portion of the high pressure nitrogen is removed from the exchange line at a temperature T1, via duct 17A, expanded at mean pressure in turbine 12A and injected into separator 38. A portion of the flow which circulates in ducts 19A is removed from the exchange line, via duct 20A, at a temperature T2 clearly higher than T1, expanded at about 1 bar in turbine 9A and injected into ducts 24A, via duct 21A at a temperature of about T1. Ducts 42 and 43 respectively connect the outlets of the ducts 19A and 24A to the intakes of the compressors 37 and 36. A duct 44 brings a flow of nitrogen gas which is equal to the flow of liquid nitrogen produced in duct 41 to the intake of compressor 36.

Preferably, in a refrigerating cycle according to the invention, the difference between T2 and T1 is generally at least equal to half the decrease of temperature produced by a turbine.

It should be noted that the hot part of the exchange line 5 or 5A can eventually be cooled, down to about −40° C., by an auxiliary refrigerating unit operating with ammonia or "Freon".

We claim:

1. Process for producing refrigeration by expansion of a fluid in a high pressure turbine, followed by expansion of a portion of the fluid originating from this turbine in a low pressure turbine, comprising passing the fluid through heat exchange means having a warm end and a cold end, prior to introduction into each of the turbines, and withdrawing said fluid from said heat exchange means prior to introduction into each of said turbines, the point of withdrawal of the fluid from said heat exchange means prior to introduction into said high pressure turbine being closer to said cold end than the point of withdrawal of the fluid from said heat exchange means prior to introduction into said low pressure turbine, whereby the inlet temperature of the high pressure turbine is lower than that of the low pressure turbine.

2. Process according to claim 1, intended for the liquefaction of a gas, wherein the inlet and the outlet temperatures of the high pressure turbine boarder the temperature zone in which the gas is liquefied.

3. Process according to claim 2, wherein the inlet and outlet temperatures of the low pressure turbine essentially border the temperature zone between the temperature at the start of the cooling produced by the turbines and the inlet temperatures of the high pressure turbine.

4. Process for air distillation in which compressed air is cooled and expanded at medium pressure in a high pressure turbine (12), and a portion of the air so expanded is sent into a double distillation column, while remaining air thus expanded is again expanded until reaching about atmospheric pressure in a low pressure turbine (9), comprising passing the air through heat exchange means having a warm end and a cold end, prior to introduction into each of the turbines, and withdrawing said air from said heat exchange means prior to introduction into each of said turbines, the point of withdrawal of the air from said heat exchange means prior to introduction into said high pressure turbine being closer to said cold end than the point of withdrawal of the air from said heat exchange means prior to introduction into said low pressure turbine, whereby the inlet temperature (T1) of the high pressure turbine is lower than that (T2) of the low pressure turbine.

5. Process according to claim 4, wherein the air originating from the low pressure turbine (9) is warmed and withdrawn after having been used to cool the compressed air to be separated to.

6. Process according to claim 4, wherein the air originating from the low pressure turbine (9) is at least partly cooled then blown into (21) a low pressure column (3) of the double column (1).

7. Process according to claim 4, wherein the air originating from the low pressure turbine (9) is warmed and withdrawn after having been used to regenerate an adsorbent for purifying this air.

8. Refrigerating cycle, of the type comprising a circuit for circulating a cycle fluid, at least one cycle compressor (36, 37), a high pressure turbine (12; 12A), and a low pressure turbine (9; 9A), said circuit comprising means for sending at least a portion of the cycle fluid which has been compressed by the compressor into the high pressure turbine after cooling to a first temperature (T1), and means for sending at least a portion of the fluid originating from the high pressure turbine into the low pressure turbine after warming to a second temperature (T2), said sending means comprising heat exchange means having a warm end and a cold end, and means for withdrawing said fluid from said heat exchange means prior to introduction into each of said turbines, the point of withdrawal of the fluid from said heat exchange means prior to introduction into said high pressure turbine being closer to said cold end than the point of withdrawal of the fluid from said heat exchange means prior to introduction into said low pressure turbine, whereby the inlet temperature (T1) of the high pressure turbine is lower than the inlet temperature (T2) of the low pressure turbine.

9. Apparatus for air distillation, of the type comprising a double air distillation column (1) and a refrigerating cycle, wherein the refrigerating cycle is as defined in claim 8, the cycle fluid being air to be separated, the apparatus comprising means (5) for cooling a portion of the incoming air to the vicinity of its dew point, expanding same in an expansion means (16) and sending it to the double column, and means (18) to send a portion of air originating from the high pressure turbine (12) to this double column.

10. Apparatus according to claim 9, which comprises means (5, 12) for warming the air originating from the low pressure turbine (9) and for withdrawing this air from the apparatus after going through a cooler for the incoming compressed air.

11. Apparatus according to claim 9, which comprises means (23) for cooling the air originating from the low pressure turbine (9) and blowing same in a low pressure column (3) of the double column.

12. Apparatus according to claim 9, which comprises means (5, 12) for warming the air originating form the low pressure turbine (9) and for withdrawing this air from the apparatus after going through a device for purifying this air by absorption.

13. In a process for producing refrigeration in a refrigeration cycle of the type comprising at least one cycle compressor (36, 37), a high pressure turbine (12; 12A), and a low pressure turbine (9; 9A), said process comprising sending at least a portion of a cycle fluid which has been compressed by the compressor, into the high pressure turbine after cooling to a first temperature (T1), and sending at least a portion of the fluid originating from said high pressure turbine, into said low pressure turbine after warming to a second temperature (T2); the improvement comprising passing the fluid through heat exchange means having a warm end and a cold end, prior to introduction into each of the turbines, and withdrawing said fluid from said heat exchange means prior to introduction into each of said turbines, the point of withdrawal of the fluid from said heat exchange means prior to introduction into said high pressure turbine being closer to said cold end than the point of withdrawal of the fluid from said heat exchange means prior to introduction into said low pressure turbine, whereby the inlet temperature (T1) of the high pressure turbine is lower than the inlet temperature (T2) of the low pressure turbine.

14. In apparatus for air distillation, comprising a high pressure turbine (12), in which compressed air to cooled and expanded at medium pressure, a double distillation column into which a portion of the air so expanded is sent, and a low pressure turbine (9), in which remaining air thus expanded is again expanded to about atmospheric pressure; the improvement comprising heat exchange means through which said air passes, said heat exchange means having a warm end and a cold end, and means for withdrawing said air from said heat exchange means prior to introduction into each of said turbines, the point of withdrawal of the air from said heat exchange means prior to introduction into said high pressure turbine being closer to said cold end than the point of withdrawal of the air from said heat exchange means prior to introduction into said low pressure turbine, whereby the inlet temperature (1) of the high pressure turbine is lower than the inlet temperature (T2) of the low pressure turbine.

* * * * *